US008816938B2

(12) United States Patent
Tamura et al.

(10) Patent No.: US 8,816,938 B2
(45) **Date of Patent: *Aug. 26, 2014**

(54) LARGE-SCALE DISPLAY DEVICE

(71) Applicant: Shinoda Plasma Corporation, Hyogo (JP)

(72) Inventors: Hiroaki Tamura, Hyogo (JP); Hitoshi Hirakawa, Hyogo (JP); Koji Shinohe, Hyogo (JP); Yoshio Shibukawa, Hyogo (JP); Takamitsu Bunno, Hyogo (JP); Kenji Awamoto, Hyogo (JP); Yoko Shinoda, Hyogo (JP); Tetsuya Makino, Hyogo (JP)

(73) Assignee: Shinoda Plasma Corporation, Hyogo (JP)

( * ) Notice: Subject to any disclaimer, the term of this patent is extended or adjusted under 35 U.S.C. 154(b) by 49 days.

This patent is subject to a terminal disclaimer.

(21) Appl. No.: 13/631,188

(22) Filed: Sep. 28, 2012

(65) Prior Publication Data

US 2013/0021222 A1 Jan. 24, 2013

Related U.S. Application Data

(63) Continuation of application No. 12/326,700, filed on Dec. 2, 2008, now Pat. No. 8,305,292.

(30) Foreign Application Priority Data

May 19, 2008 (JP) ..... 2008-130991

(51) Int. Cl.

| | |
|---|---|
| ***G09G 5/00*** | (2006.01) |
| ***H01J 11/18*** | (2012.01) |
| ***G09F 9/313*** | (2006.01) |

(52) U.S. Cl.

CPC ..... *H01J 11/18* (2013.01); *G09F 9/313* (2013.01)

USPC ..... 345/1.3; 345/1.1; 345/60

(58) Field of Classification Search

CPC ..... G09G 2300/02; G09G 2300/023; G09G 2300/026; G06F 3/1423; G02F 1/13336

See application file for complete search history.

(56) References Cited

U.S. PATENT DOCUMENTS

| | | | | |
|---|---|---|---|---|
| 8,305,292 | B2 * | 11/2012 | Tamura et al. | 345/1.3 |
| 2004/0222941 | A1 * | 11/2004 | Wong et al. | 345/1.1 |

(Continued)

FOREIGN PATENT DOCUMENTS

| | | |
|---|---|---|
| JP | 2004-351784 | 5/1997 |
| JP | 2005017738 | 1/2005 |

(Continued)

OTHER PUBLICATIONS

Machine translation of JP2001-265256.*

*Primary Examiner* — Lixi C Simpson

(74) *Attorney, Agent, or Firm* — Stites & Harbison PLLC; Nicolo Davidson

(57) ABSTRACT

A large-scale display device having a plurality of display units which each include a plurality of elongated plasma tubes each filled with a discharge gas, and at least one pair of display electrodes disposed outside the plasma tubes, voltage applying means which applies a drive voltage to the display electrodes to cause electric discharge in the plasma tubes for display.

Vertically adjoining ones of the display units respectively have adjoining portions which are offset thicknesswise from each other for prevention of contact between the plasma tubes of the vertically adjoining display units. The voltage applying means is disposed away from the adjoining portions of the vertically adjoining display units.

10 Claims, 22 Drawing Sheets

(56) References Cited

U.S. PATENT DOCUMENTS

| | | | | |
|---|---|---|---|---|
| 2006/0044215 | A1* | 3/2006 | Brody et al. | 345/1.3 |
| 2007/0001927 | A1* | 1/2007 | Ricks et al. | 345/1.1 |

FOREIGN PATENT DOCUMENTS

| | | |
|---|---|---|
| JP | 2004-351784 | 6/2006 |
| JP | 2006278161 | 10/2006 |
| WO | WO2008050445 | 5/2008 |

* cited by examiner 103a
32
3
110
12
100a
Da
D
2
31

103a
110
12
100a
Da
D 103a
110
11
100a
Da
D

LARGE-SCALE DISPLAY DEVICE

CROSS-REFERENCE TO RELATED APPLICATIONS

This application is a continuation of U.S. application Ser. No. 12/326,700, filed Dec. 2, 2008, which claims priority under 35 USC §119 to Japanese patent application No. 2008-130991, filed May 19, 2008, the entire disclosures of which are herein incorporated by this reference.

BACKGROUND OF THE INVENTION

1. Field of the Invention

The present invention relates to a large-scale display device employing PTAs (plasma tube arrays).

2. Description of the Related Art

A gas discharge tube including a glass tube having a diameter of about 1 mm and filled with a discharge gas with opposite ends thereof sealed and a fluorescent layer provided on an interior surface of the glass tube is generally called "plasma tube". A display panel including a multiplicity of such plasma tubes regularly arranged, a plurality of transparent display electrodes provided on a front side thereof as extending perpendicularly to the plasma tubes and data electrodes (address electrodes) provided on a back side thereof as extending parallel to the plasma tubes is generally called "plasma tube array (PTA)". In the PTA, electric discharge is caused by applying given operating voltages to the display electrodes and the data electrodes, and vacuum UV radiation generated by the electric discharge excites a fluorescent material, which in turn emits visible light for display.

In principle, the size of the display device employing the PTAs is determined by the length and number of the plasma tubes. If a large-scale display panel is produced from a single PTA, however, it is difficult to transport the display panel from a plant into an installation site. To cope with this, a plurality of smaller-size PTA unit modules each having a smaller thickness and a light weight are produced, and assembled at the installation site to be connected to each other with the use of a module connection structure.

The PTA unit modules basically each have a screen size of about 1 m×1 m. The use of the PTA unit modules makes it possible to construct large-scale display devices having various screen sizes. Where six unit modules are arrayed in a 3×2 matrix, for example, the resulting display device has a screen size of 3 m×2 m. In this case, however, connection portions present between the PTA unit modules should be concealed in order to serve the unit modules as a single panel display device. A known method for concealing the connection portions is to minimize the width of the connection portions by keeping vertically aligned unit modules into abutment with each other (see, for example, JP-A-2006-164635).

A large-scale display device employing a plurality of flat display devices such as LCDs or PDPs instead of the PTAs is also known (see, for example, JP-A-9(1997)-130701). In the large-scale display device, the flat display devices each include a driving section disposed along one or two peripheral edges of a rectangular image display region thereof, and are arrayed so that peripheral edges thereof not provided with the driving sections abut with each other to make their seams inconspicuous and the driving sections are covered with the image display regions to be concealed.

Where the PTA unit modules abut with each other in the large-scale display device, however, ends of the plasma tubes abut against each other. This causes the ends of the glass tubes to be abraded by each other, so that the glass tubes are liable to be damaged to be broken. If the glass tube of a plasma tube is broken, the discharge gas is escaped from the plasma tube. Therefore, the electric discharge is no longer established in that plasma tube, so that a defect occurs on the display screen to significantly reduce the display quality.

Further, opposite end portions of the glass tube are closed with a sealing material for sealing the discharge gas in the plasma tube. Therefore, seal portions of the plasma tubes sealed with the sealing material are each defined as a non-display region in which the electric discharge does not occur. If the thickness of the seal portion is reduced to reduce the size of the non-display region, the probability of the escape of the discharge gas is correspondingly increased.

SUMMARY OF THE INVENTION

In view of the foregoing, it is an object of the present invention to provide a large-scale display device including a plurality of PTA unit modules arrayed without abutment between ends of plasma tubes thereof.

According to the present invention, there is provided a large-scale display device including: a plurality of display units which each include a plurality of elongated plasma tubes each filled with a discharge gas, and at least one pair of display electrodes disposed outside the plasma tubes; and voltage applying means which applies a drive voltage to the display electrodes to cause electric discharge in the plasma tubes for display; wherein vertically adjoining ones of the display units respectively have adjoining portions which are offset thicknesswise from each other for prevention of contact between the plasma tubes of the vertically adjoining display units; wherein the voltage applying means is disposed away from the adjoining portions of the vertically adjoining display units.

According to the present invention, the vertically adjoining display units are offset thicknesswise from each other, so that the display units can be arrayed without abutment between ends of the plasma tubes. This prevents the breakage of the plasma tubes.

DETAILED DESCRIPTION OF THE INVENTION

A large-scale display device according to one aspect of the present invention includes: a plurality of display units which each include a plurality of elongated plasma tubes each filled with a discharge gas, and at least one pair of display electrodes disposed outside the plasma tubes; and voltage applying means which applies a drive voltage to the display electrodes to cause electric discharge in the plasma tubes for display; wherein vertically adjoining ones of the display units respectively have adjoining portions which are offset thicknesswise from each other for prevention of contact between the plasma tubes of the vertically adjoining display units; wherein the voltage applying means is disposed away from the adjoining portions of the vertically adjoining display units.

The vertically adjoining display units may overlap each other to respectively have overlap portions.

The large-scale display device may further include a sheet structure provided between the overlap portions of the vertically adjoining display units to prevent direct contact between the vertically adjoining display units.

The sheet structure is preferably previous to light.

The vertically adjoining display units are preferably continuous through the overlap portions thereof to define a single display screen.

A non-display region is defined by the overlap portions of the vertically adjoining display units.

A large-scale display device according to another aspect of the present invention includes a plurality of plasma tube arrays (PTAs) arranged in a matrix, and a support member which supports the PTAs so that PTAs aligned in a row direction of the matrix adjoin each other with no step therebetween and PTAs aligned in a column direction of the matrix adjoin each other with a step therebetween, wherein the PTAs each include a plurality of plasma tubes extending parallel to each other in the column direction, a plurality of display electrodes extending parallel to each other perpendicularly to the plasma tubes, and a plurality of address electrodes extending parallel to each other along the plasma tubes.

The PTAs are intrinsically flexible, and supported as being curved in the row direction by the support member.

The support member supports the PTAs so that each two adjacent PTAs aligned in the column direction overlap each other.

The large-scale display device preferably further includes a connection member which electrically connects display electrodes of each two adjacent PTAs aligned in the row direction in series.

The large-scale display device may further include a display electrode drive circuit which is connected to display electrodes of a PTA located at an end of each row of the matrix to apply a common signal voltage to PTAs located in the each row, and an address electrode drive circuit which is connected to address electrodes of each PTA to apply an independent signal voltage to the each PTA.

Basic Construction of Plasma Tube Array (PTA)

Figure 1:
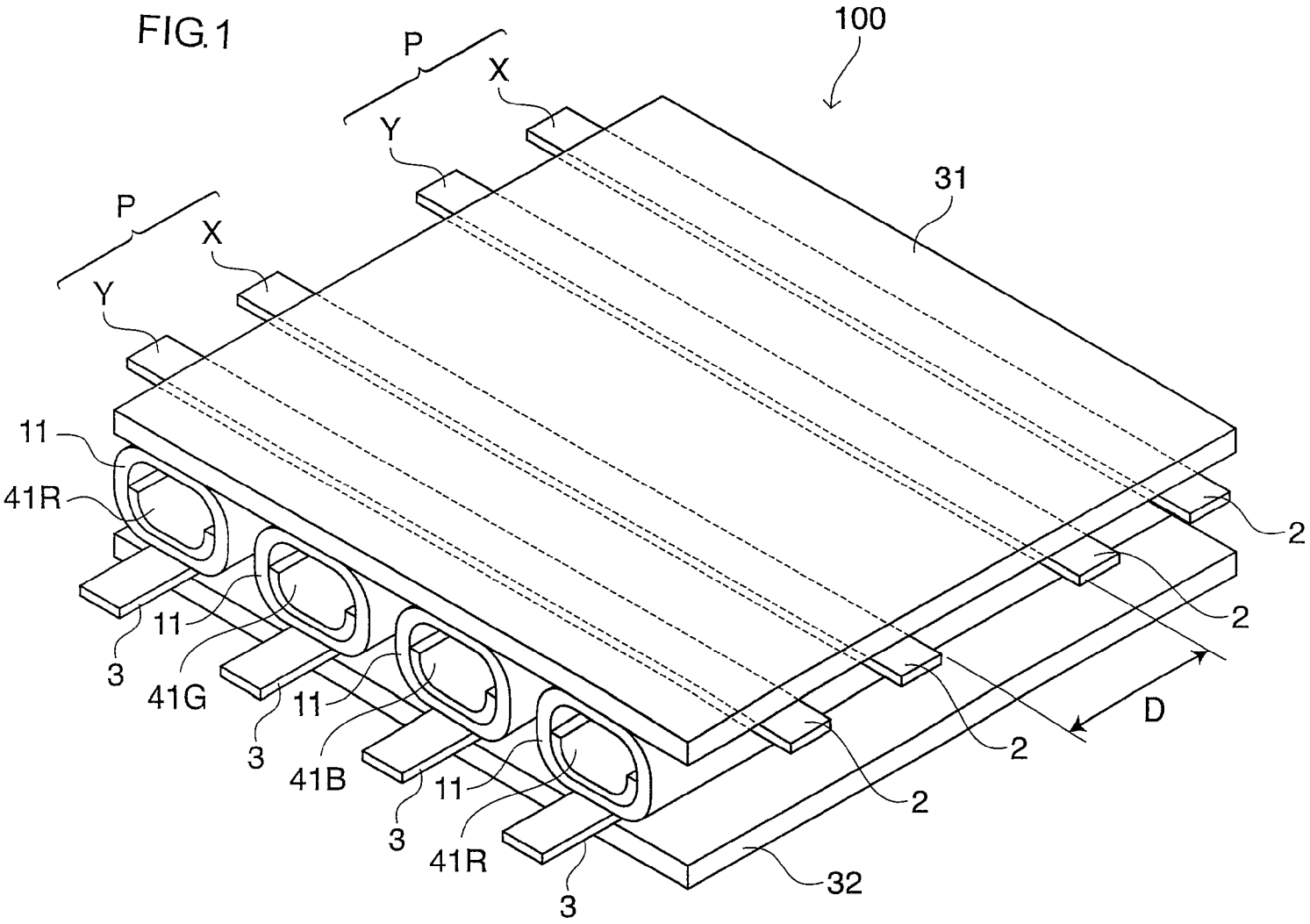
FIG. 1 is a diagram for explaining the construction of a PTA according to the present invention.

FIG. 1 is a partial perspective view showing the basic construction of a PTA 100 according to the present invention. In FIG. 1, the PTA 100 includes plasma tubes 11 arranged parallel to each other, a transparent front side support plate 31, a transparent or opaque back side support plate 32, a plurality of display electrode pairs P, and a plurality of signal electrodes or address electrodes 3. In FIG. 1, the electrode pairs P each include two display electrodes 2, i.e., a sustain electrode X and a scanning electrode Y. The support plates 31, 32 are each formed of a flexible PET film, for example, having a thickness of 0.5 mm.

Red (R), green (G) and blue (B) fluorescent layers 41R, 41G, 41B are respectively formed on rear interior surface portions of the plasma tubes 11. A discharge gas is filled in the plasma tubes 11, and opposite ends of each of the plasma tubes 11 are sealed.

The address electrodes 3 are provided on a front surface or an inner surface of the back side support plate 32 as extending longitudinally of the plasma tubes 11. The address electrodes 3 are arranged at the same pitch as the plasma tubes 11, and the pitch is typically 1 to 1.5 mm. The plurality of display electrode pairs P are provided on a rear surface or an inner surface of the front side support plate 31 as extending perpendicularly to the address electrodes 3. The electrodes X, Y each have a width of 0.75 mm, for example. The electrodes X, Y of each of the display electrode pairs P are spaced, for example, a distance of 0.4 mm from each other. An elongated non-display region or a non-discharge gap, for example, having a width D of 1.1 mm is provided between each two adjacent display electrode pairs P.

When the PTA 100 is assembled, the address electrodes 3 are brought into intimate contact with lower outer peripheral surface portions of the respective plasma tubes 11, and the display electrodes 2 are brought into intimate contact with upper outer peripheral surface portions of the respective plasma tubes 11. An adhesive may be provided between the outer peripheral surface portions of the plasma tubes 11 and the address and display electrodes 3, 2 for improvement of the adhesion between the plasma tubes 11 and the address and display electrodes 3, 2.

Intersections between the address electrodes 3 and the display electrode pairs P as seen in plan from the front side of the PTA 10 are each defined as a unit light emitting region. For display, a light emitting region is selected by establishing a selection discharge at an intersection between a scanning electrode Y and an address electrode 3, and a display discharge is established by wall charges generated in the light emitting region on the interior surface of the tube to cause a fluorescent layer to emit light. The selection discharge is an opposed discharge established in the plasma tube 11 between the scanning electrode Y and the address electrode 3. The display discharge is a surface discharge established in the plasma tube 11 between a sustain electrode X and the scanning electrode Y disposed parallel to each other in a plane.

Drive Circuits for PTA

Figure 2:
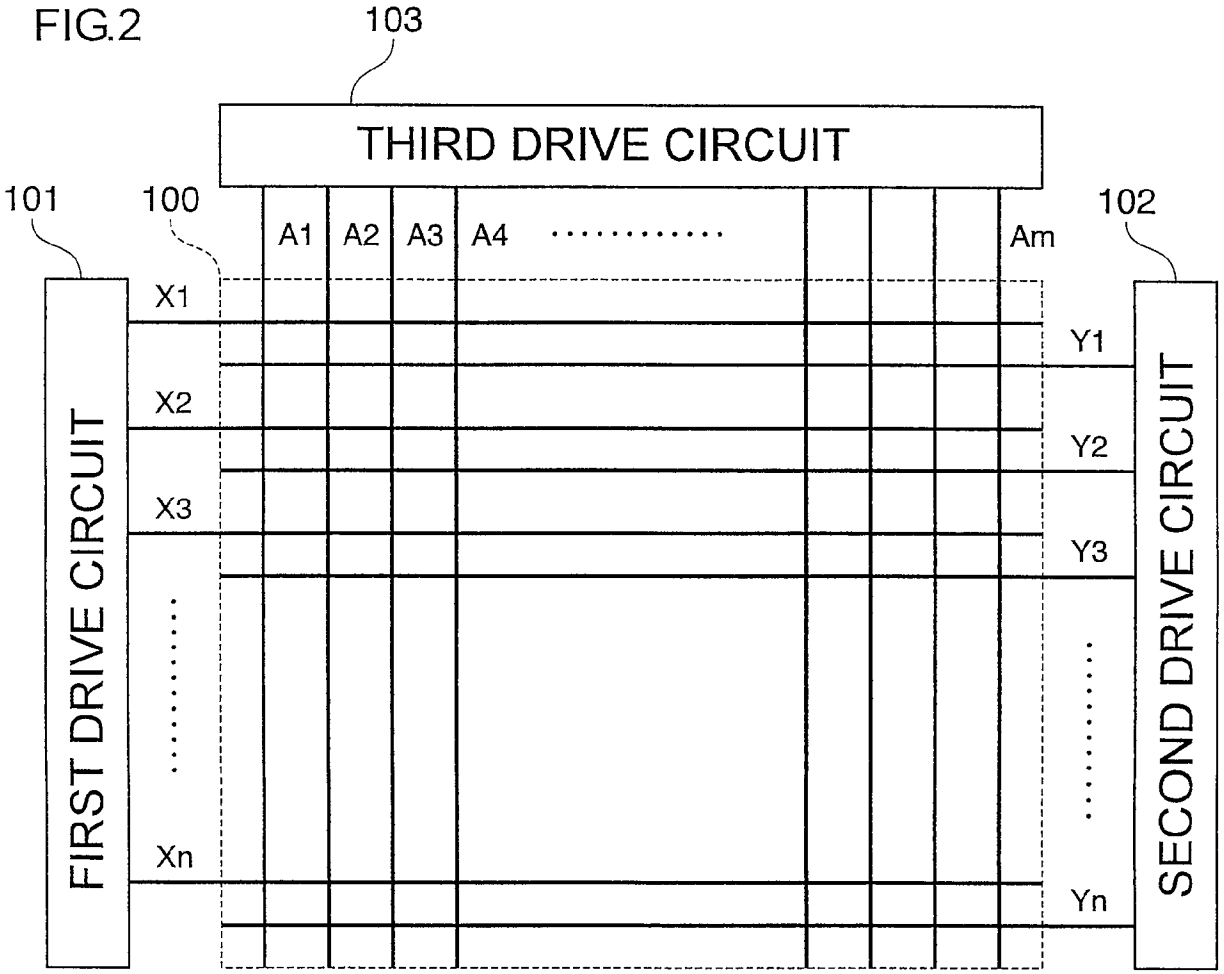
FIG. 2 is a block diagram illustrating drive circuits for the PTA according to the present invention.

FIG. 2 is a block diagram illustrating drive circuits for driving the PTA 100. As shown in FIG. 2, a drive voltage is applied to sustain electrodes X1 to Xn from a first drive circuit 101. A drive voltage is applied to scanning electrodes Y1 to Yn from a second drive circuit 102. An address voltage is applied to address electrodes A1 to Am from a third drive circuit 103.

Figure 3:
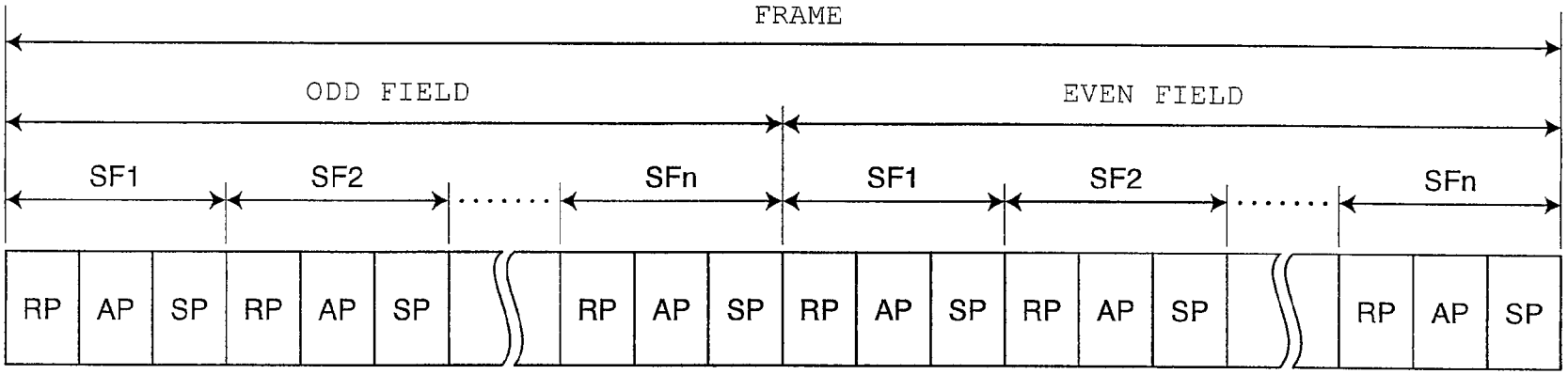
FIG. 3 is a diagram for explaining the configuration of a display frame of the PTA according to the present invention.

FIG. 3 shows the configuration of a single frame of a display image. The frame is divided into two fields, i.e., an odd field and an even field. The odd field and the even field each include a plurality of subfields SF1 to SFn. In the odd field, the first, second and third drive circuits 101, 102, 103 apply the voltages to the electrodes so as to perform a reset operation, an address operation and a display operation in odd display lines of the PTA 100 shown in FIG. 2 as will be described later in detail. In the even field, the first, second and third drive circuits 101, 102, 103 apply the voltages to the electrodes to perform the reset operation, the address operation and the display operation in even display lines of the PTA 100.

Therefore, as shown in FIG. 3, the subfields SF1 to SFn each include a reset period RP during which the reset operation is performed to uniformize charges in all display cells of the subfield screen, an address period AP during which the address operation is performed to establish an address discharge in predetermined unit light emitting regions or display cells to select the display cells and accumulate wall charges in the selected display cells, and a display (sustain) period SP during which the display operation is performed to sustain the discharge in the selected display cells by using the accumulated wall charges.

In the reset operation in the reset period RP, a reset pulse is applied between the sustain electrodes X and the scanning electrodes Y of the respective display electrode pairs P to cause electric discharge for erasing the wall charges in the respective display cells. In the address operation in the address period AP, a scan pulse is sequentially applied to the scanning electrodes Y, and an address pulse is applied to address electrodes A corresponding to display cells to be energized in synchronization with the application of the scan pulse, whereby the address discharge is established in display cells located at addresses defined by intersections between the scanning electrodes Y and the address electrodes A to generate wall charges in these display cells. In the display operation in the sustain period SP, a sustain pulse (sustain voltage) is applied to the sustain electrodes X and the scanning electrodes Y of the respective display electrode pairs P to establish a sustain discharge in the display cells or the unit light emitting regions in which the wall charges are generated.

Gradation display is achieved by changing the duration of the display period SP (the number of times of the discharge) during which the display operation is performed in each of the subframes according to display data. Where the ratio of the numbers of the times of the discharge in the eight subframes is set to 1:2:4:8:16:32:64:128, for example, each unit light emitting region has 256 gradation levels. Each pixel is defined by three unit light emitting regions, so that full color display of about 16.77 (=256×256×256) million color tones can be achieved.

PTA Unit Modules

Figure 4:
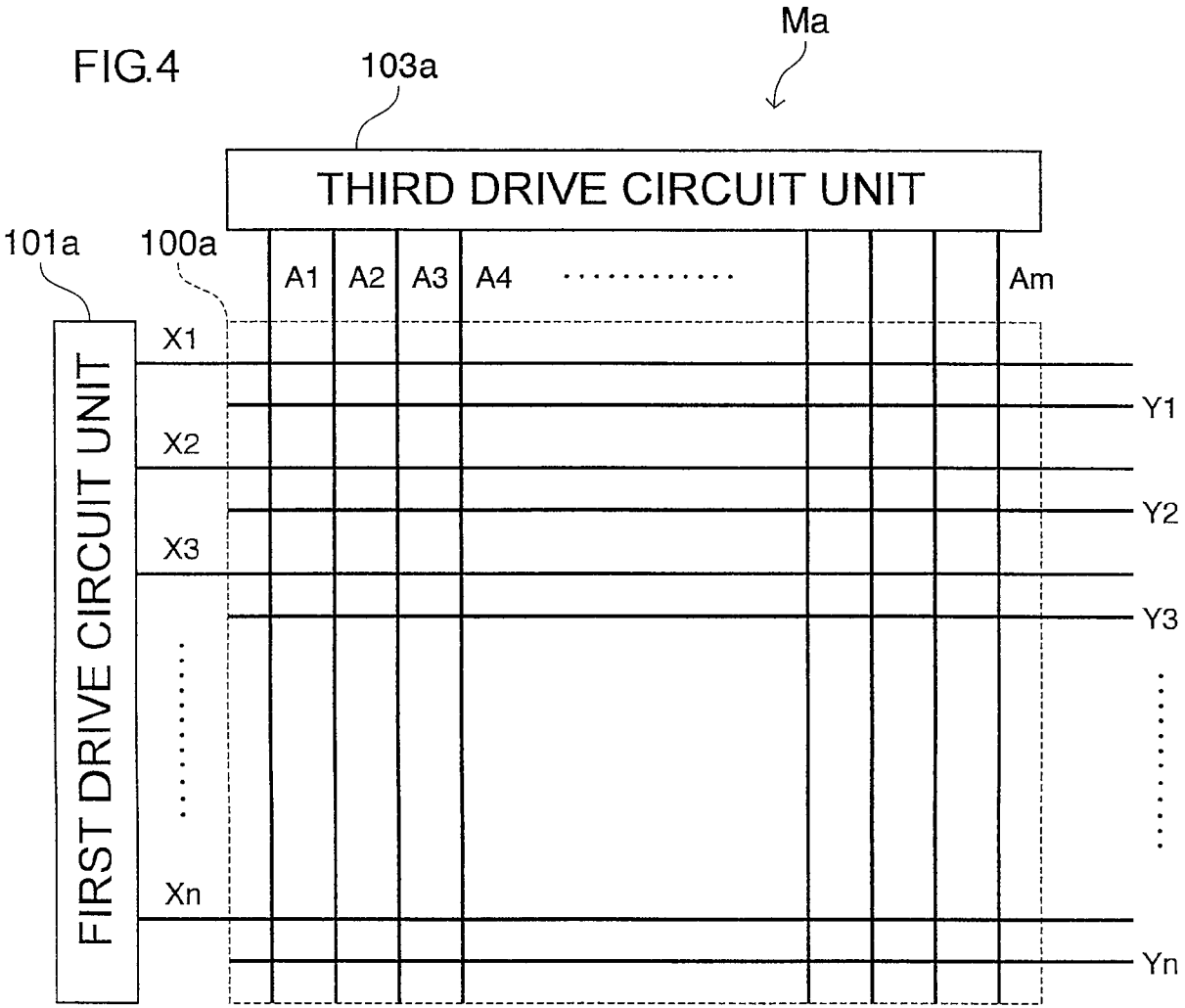
FIGS. 4 to 6 are block diagrams illustrating drive circuits of unit modules according to the present invention.
Figure 5:
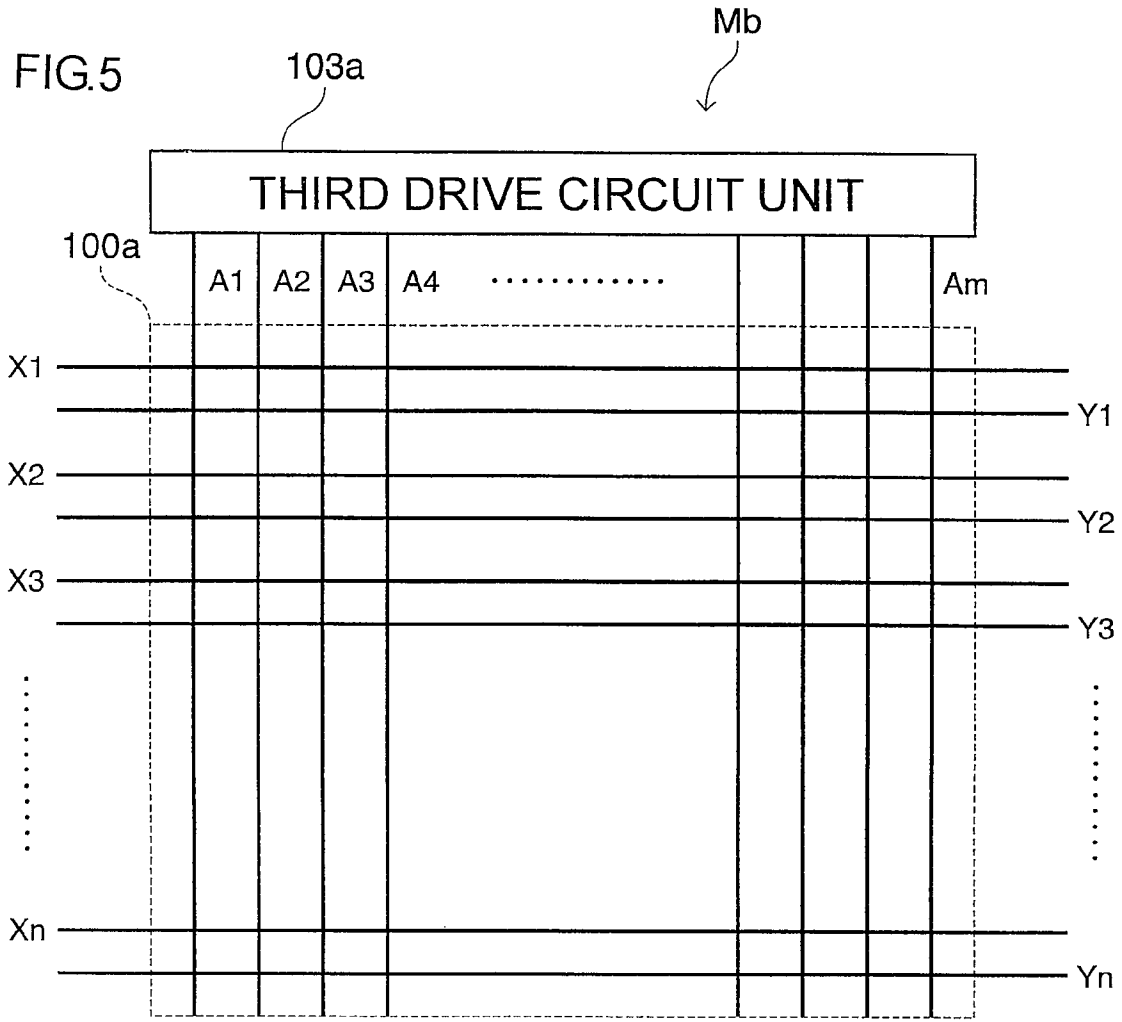
Figure 6:
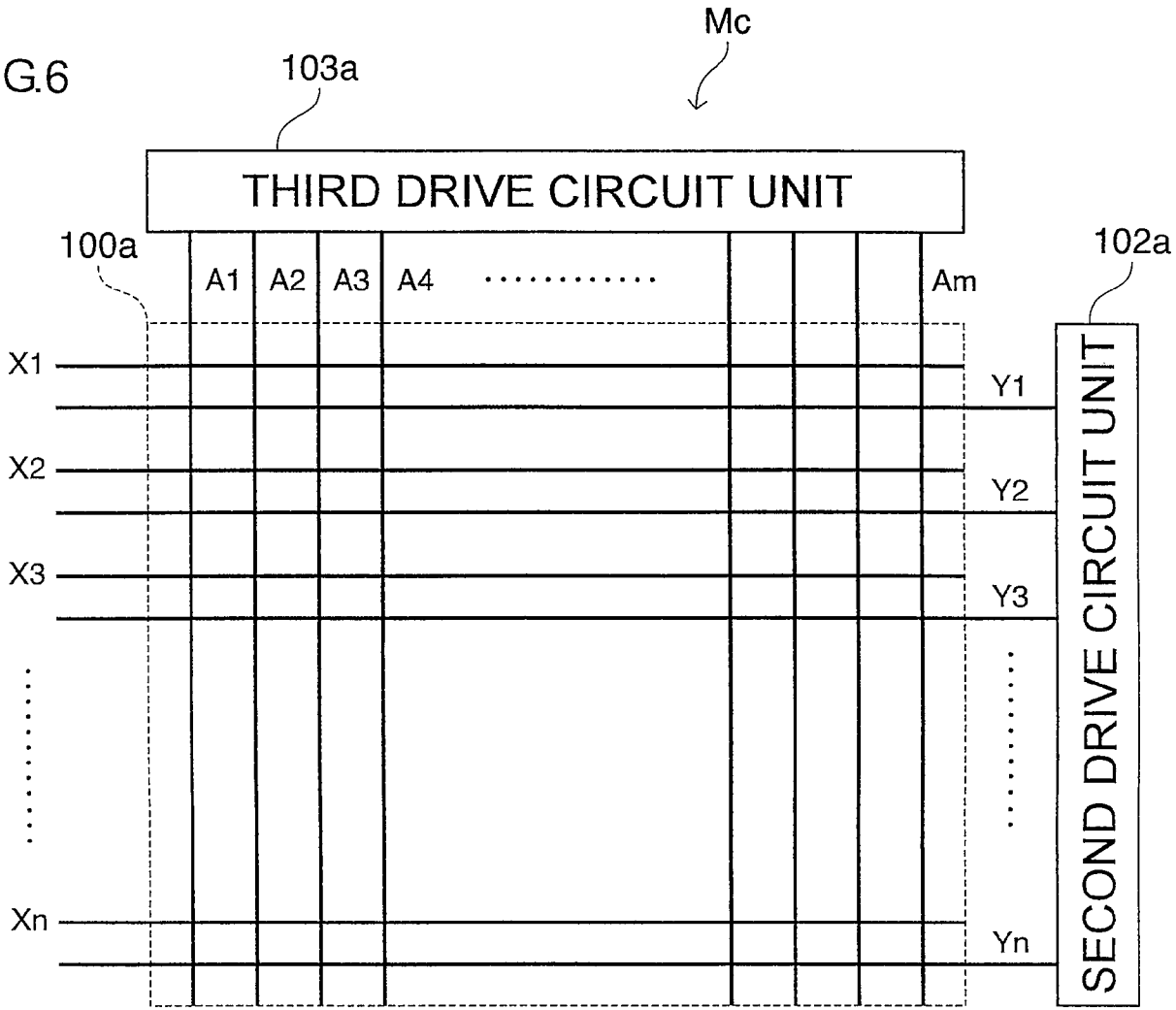

FIGS. 4 to 6 are block diagrams illustrating drive circuits of PTA unit modules (hereinafter referred to as "unit modules") Ma, Mb, Mc according to the present invention.

In these figures, a PTA 100*a* corresponds to the PTA 100 shown in FIGS. 1 and 2, and a first drive circuit unit 101*a*, a second drive circuit unit 102*a* and a third drive circuit unit 103*a* respectively correspond to the first drive circuit 101, the second drive circuit 102 and the third drive circuit 103.

Figures 7A, 7B, 7C:
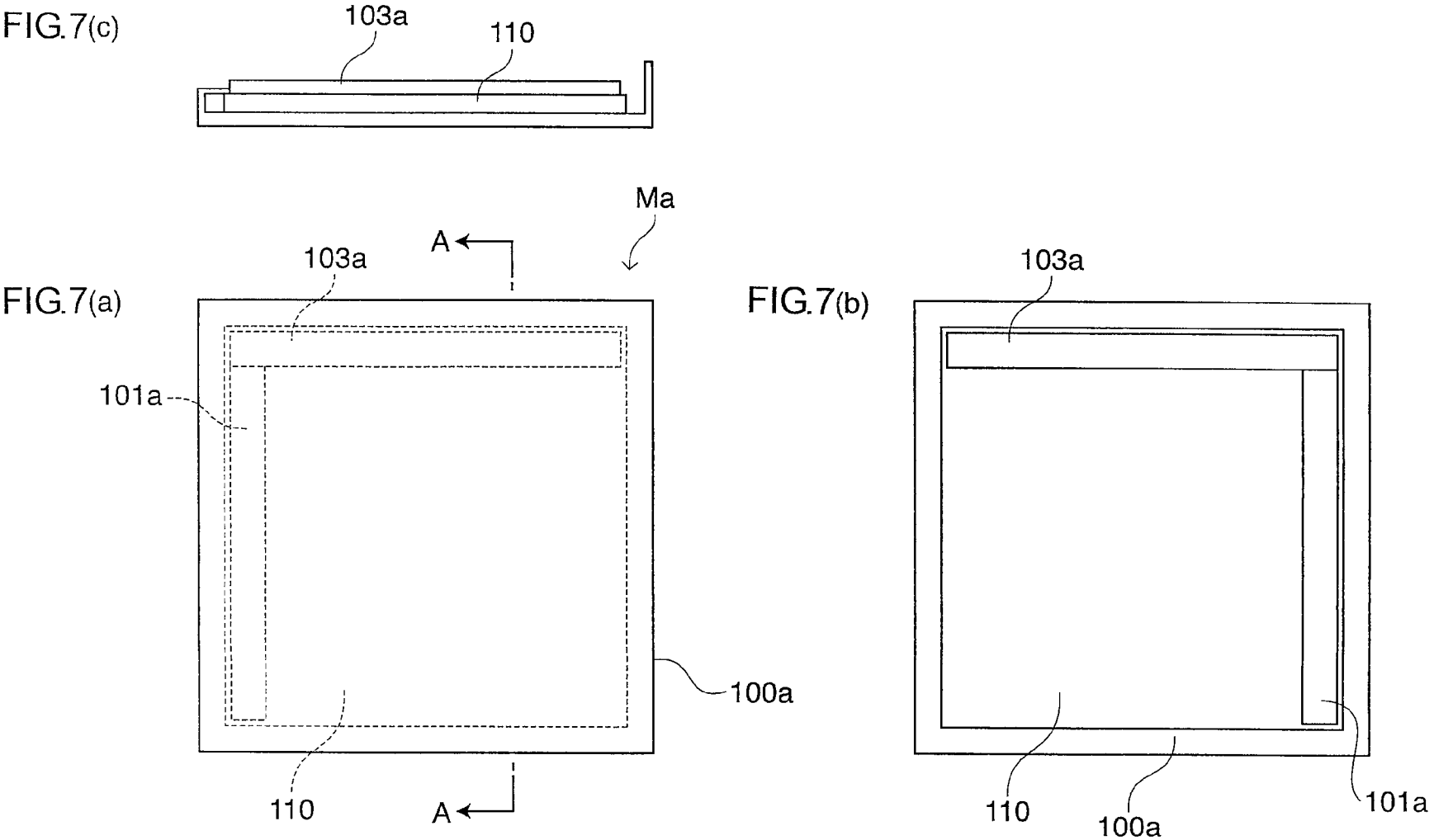
FIGS. 7(*a*) to 7(*c*), 8(*a*) to 8(*c*) and 9(*a*) to 9(*c*) are diagrams for explaining the appearances of the unit modules according to the present invention.

FIGS. 7(*a*), 7(*b*) and 7(*c*) are a front view, a rear view and a top view, respectively, showing the appearance of the unit module Ma. In the unit module Ma, as shown in these figures, the PTA 100*a* is supported from the back side by a PTA support frame 110, and the first drive circuit unit 101*a* and the third drive circuit unit 103*a* are mounted on the support frame 110.

Figure 8B:
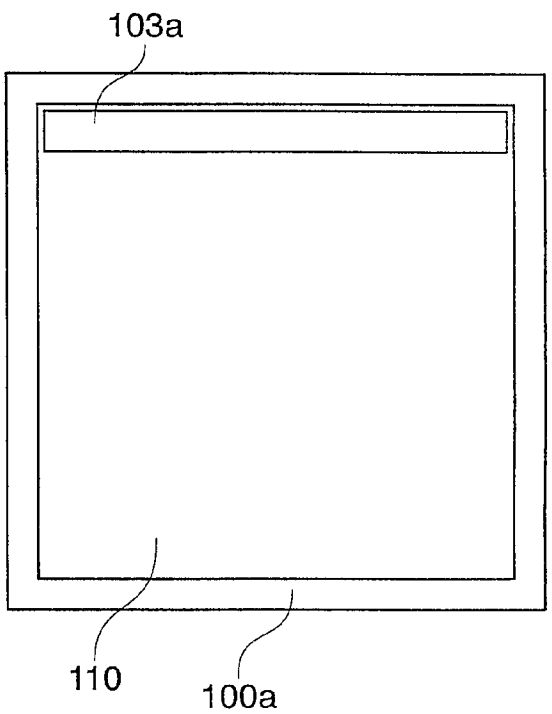
Figure 8C:
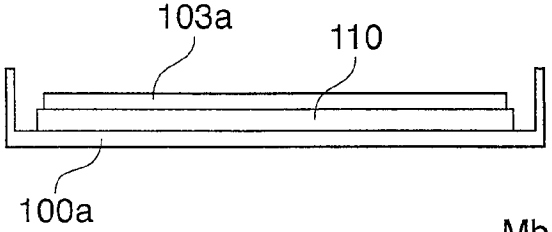
Figure 8A:
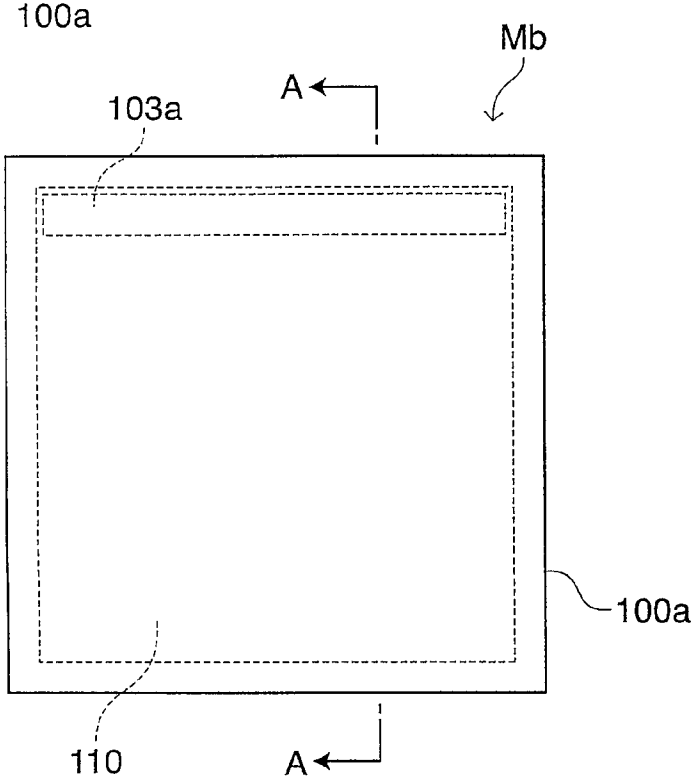

FIGS. 8(*a*), 8(*b*) and 8(*c*) are a front view, a rear view and a top view, respectively, showing the appearance of the unit module Mb. In the unit module Mb, as shown in these figures, the PTA 100*a* is supported from the back side by a support frame 110, and a third drive circuit unit 103*a* is mounted on the support frame 110.

Figure 9B:
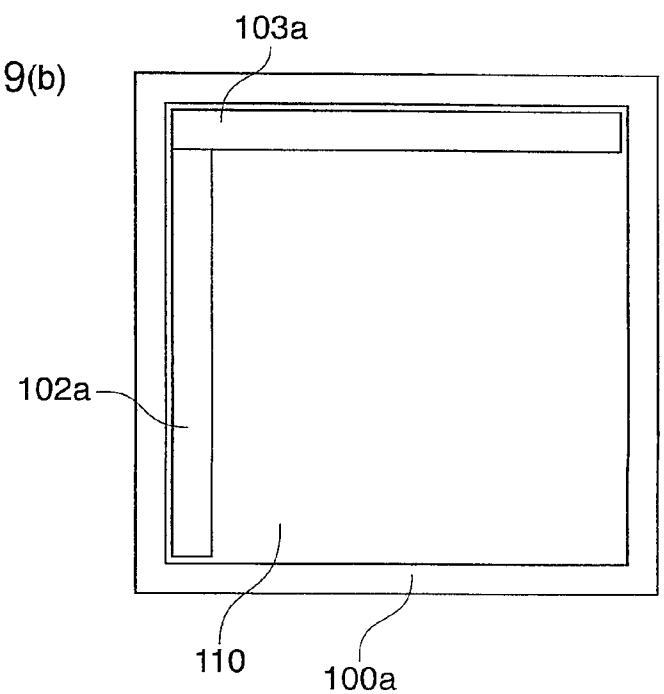
Figure 9C:
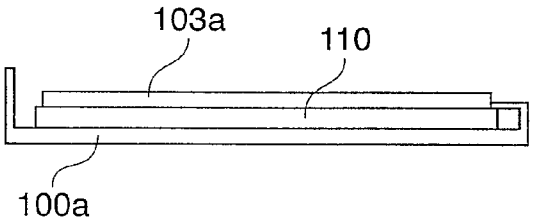
Figure 9A:
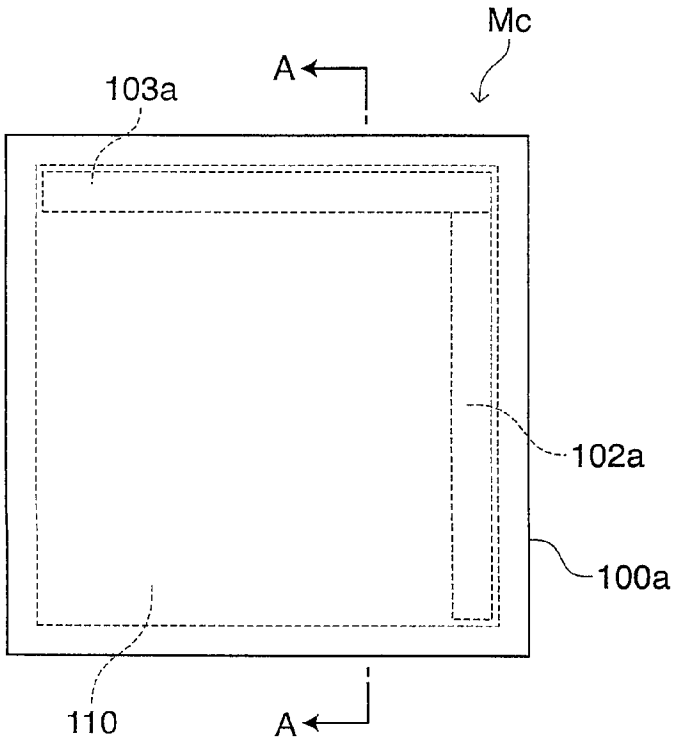

FIGS. 9(*a*), 9(*b*) and 9(*c*) are a front view, a rear view and a top view, respectively, showing the appearance of the unit module Mc. In the unit module Mc, as shown in these figures, the PTA 100*a* is supported from the back side by a support frame 110, and a second drive circuit unit 102*a* and a third drive circuit unit 103*a* are mounted on the support frame 110.

Figures 10A, 10B, 10C:
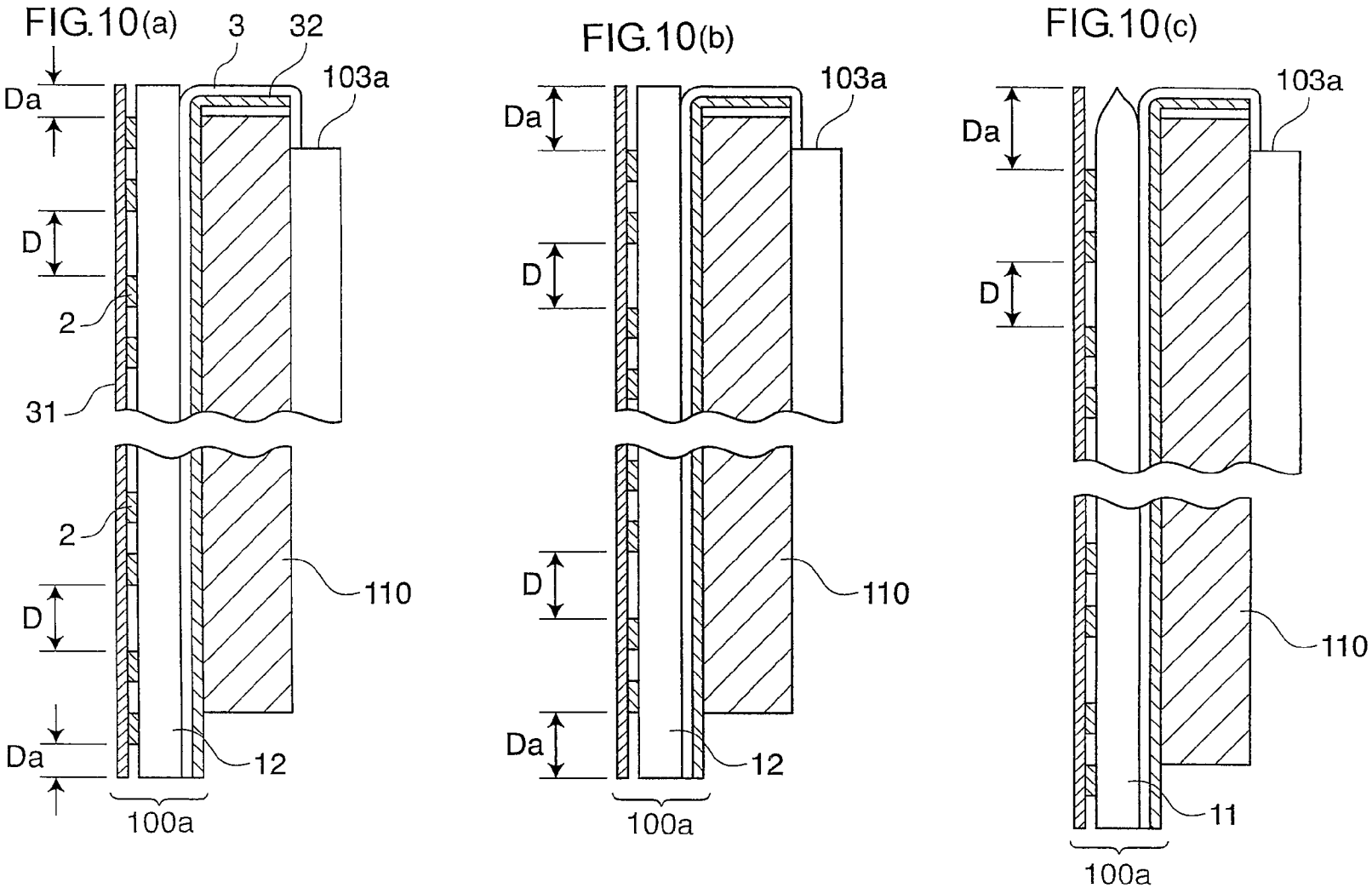
FIGS. 10(*a*) to 10(*c*) are sectional views as seen in an arrow direction A-A in FIG. 7(*a*), 8(*a*) or 9(*a*).

FIGS. 10(*a*), 10(*b*) and 10(*c*) are sectional views as seen in an arrow direction A-A in FIG. 7(*a*), 8(*a*) or 9(*a*).

Figure 11:
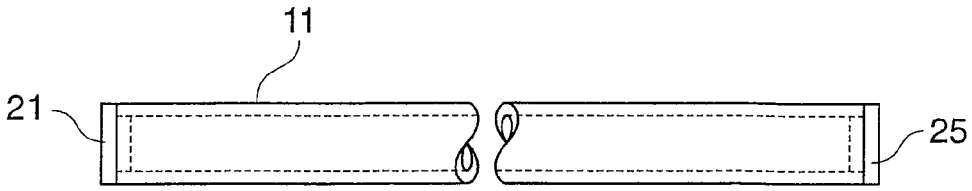
FIGS. 11 and 12 are front views of plasma tubes according to the present invention.

In the PTA 100*a* shown in FIG. 10(*a*), plasma tubes 11 each have flat opposite ends respectively sealed with seal pieces 21, 25 as shown in FIG. 11, and a relationship between the width Da of each of non-display regions provided along opposite edges of the PTA 100*a* and the width D of each of the other non-display regions is Da≤D/2.

In the PTA 100*a* shown in FIG. 10(*b*), plasma tubes 11 each have flat opposite ends as shown in FIG. 11, and a relationship between the width Da of each of non-display regions provided along opposite edges of the PTA 100*a* and the width D of each of the other non-display regions is D/2<Da≤D.

Figure 12:
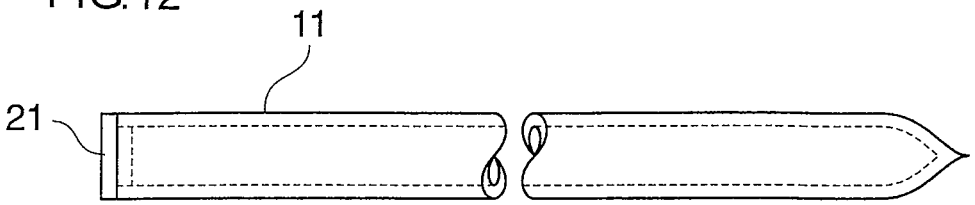

In the PTA 100*a* shown in FIG. 10(*c*), plasma tubes 11 each have opposite ends only one of which is flat and sealed with a sealing piece 21 as shown in FIG. 12, and a relationship between the width Da of a non-display region provided along an edge of the PTA 100*a* and the width D of each of the other non-display regions is Da>D.

A method for the flat sealing of the end of the plasma tube is disclosed in JP-A-2006-164635.

Large-Scale Display Device Employing PTAs

Figure 13:
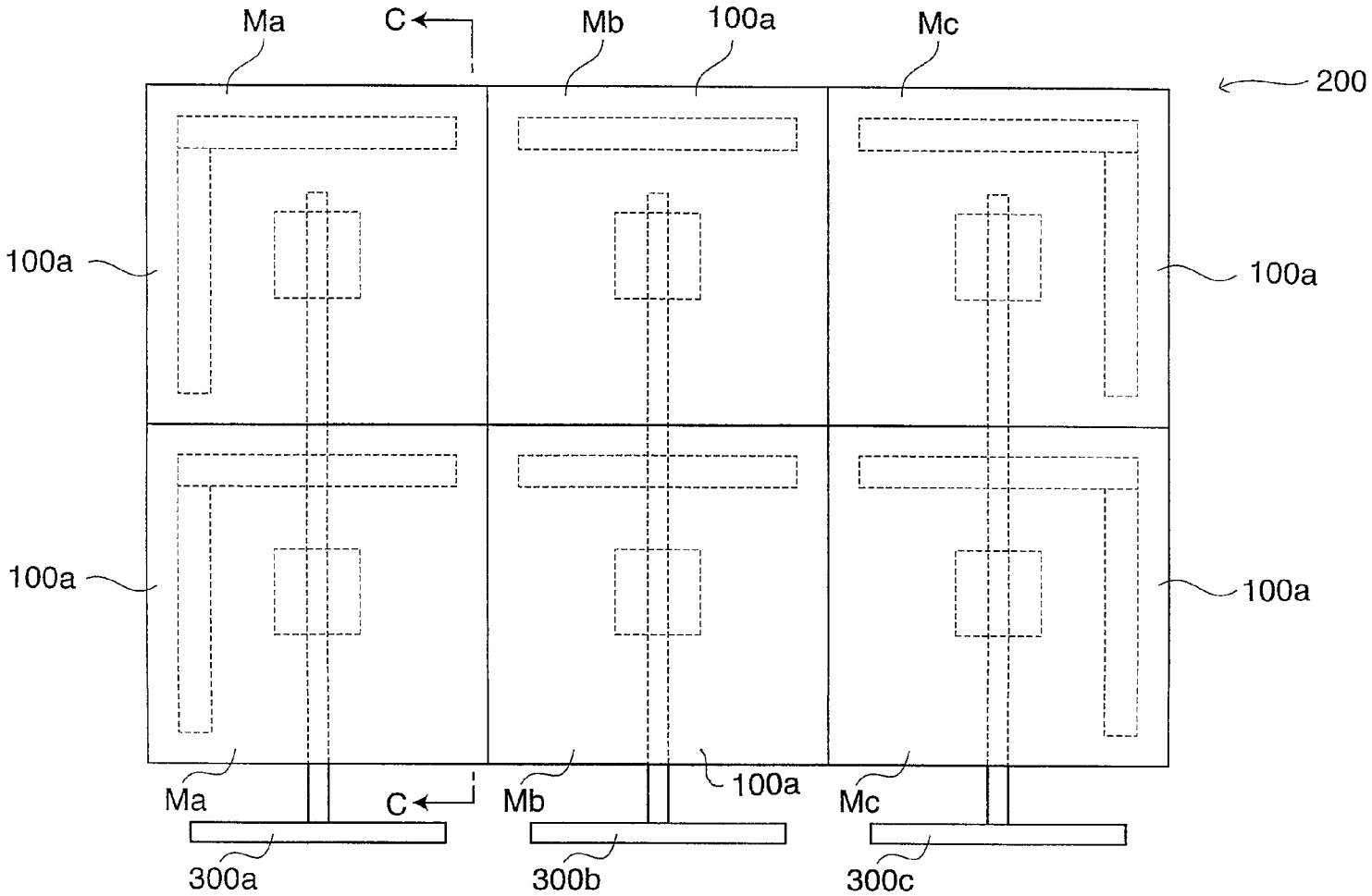
FIGS. 13, 14 and 15 are a front view, a side view and a top view of a PTA device according to the present invention.
Figure 14:
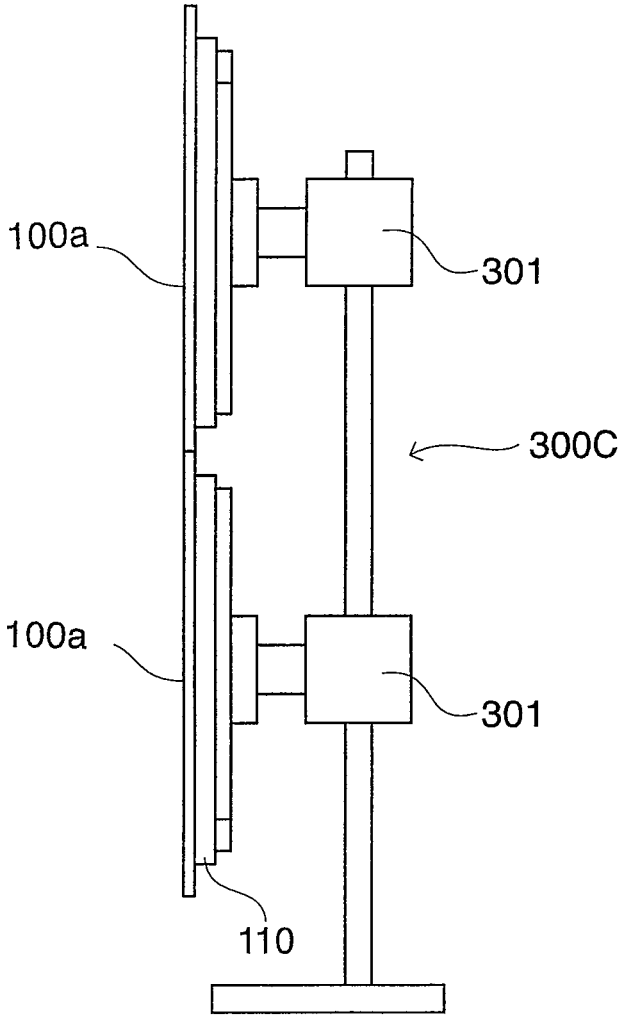
Figure 15:
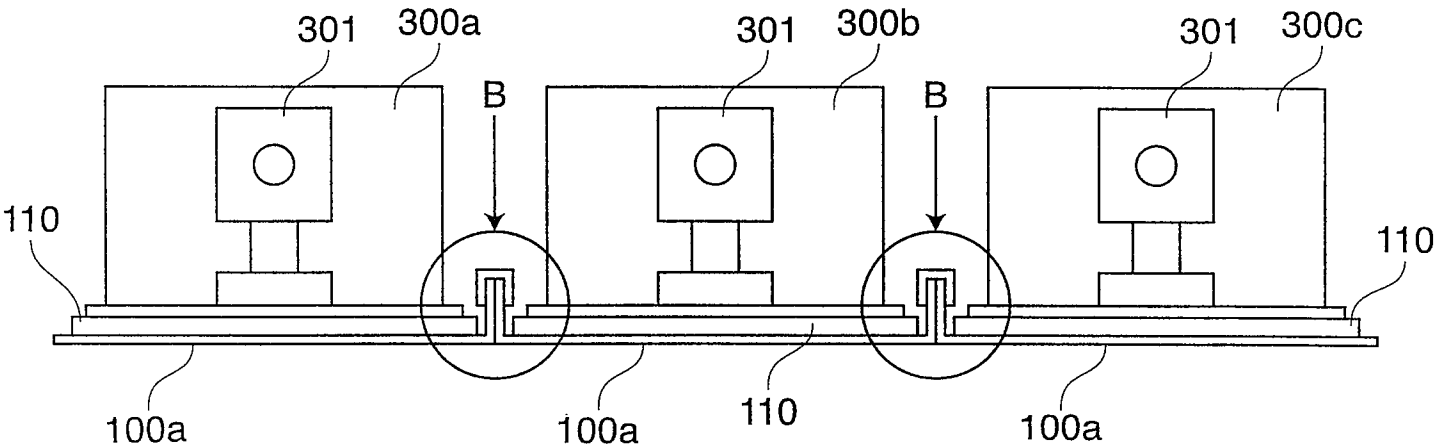

FIGS. 13, 14 and 15 are a front view, a side view and a top view of a large-scale display device employing PTAs (hereinafter referred to as "PTA device") according to the present invention.

In the PTA device 200 shown in these figures, two sets of three unit modules Ma, Mb, Mc are supported by support stands 300*a*, 300*b*, 300*c* via positioning mechanisms 301, so that six PTAs 100*a* are arrayed in a 2×3 matrix.

The six PTAs 100*a* arrayed in the matrix as shown in FIG. 13 are positioned by the positioning mechanisms 301 so that PTAs 100*a* aligned in a row direction of the matrix adjoin each other with no step therebetween and PTAs 100*a* aligned in a column direction of the matrix adjoin each other with a step therebetween.

Figure 16:
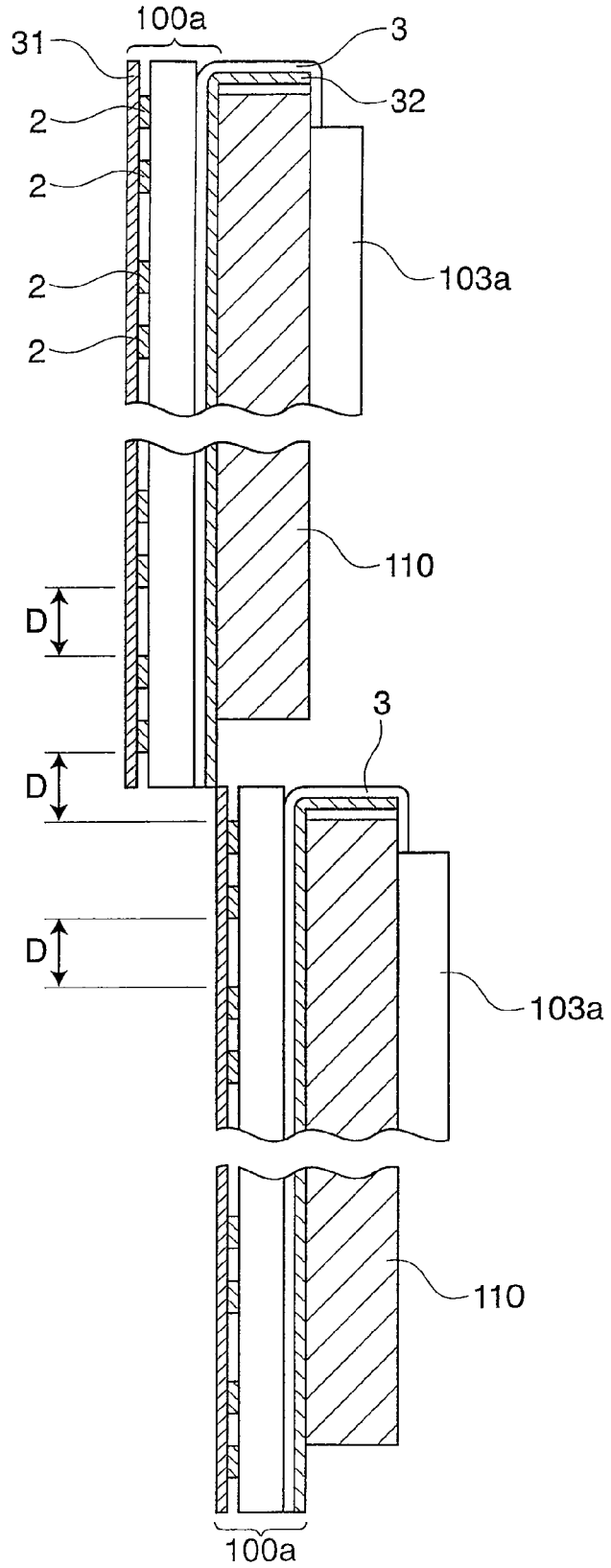
FIGS. 16 to 19 are sectional views as seen in an arrow direction C-C in FIG. 13.

FIGS. 16 to 19 are sectional views as seen in an arrow direction C-C in FIG. 13. In FIG. 16, the edge non-display regions of the PTAs 100*a* of the unit modules Ma, Mb, Mc arranged in the two rows each have a width Da≤D/2 as shown in FIG. 10(*a*). In this case, the unit modules aligned in a first row are offset by the thickness of the PTA 100*a* from the unit modules aligned in a second row with no overlap. Thus, the non-display regions present on the connection portions between the unit modules aligned in the first row and the unit modules aligned in the second row each have a width equal to the width D. This prevents the reduction in display quality (uneven display) attributable to the connection portions.

Figure 17:
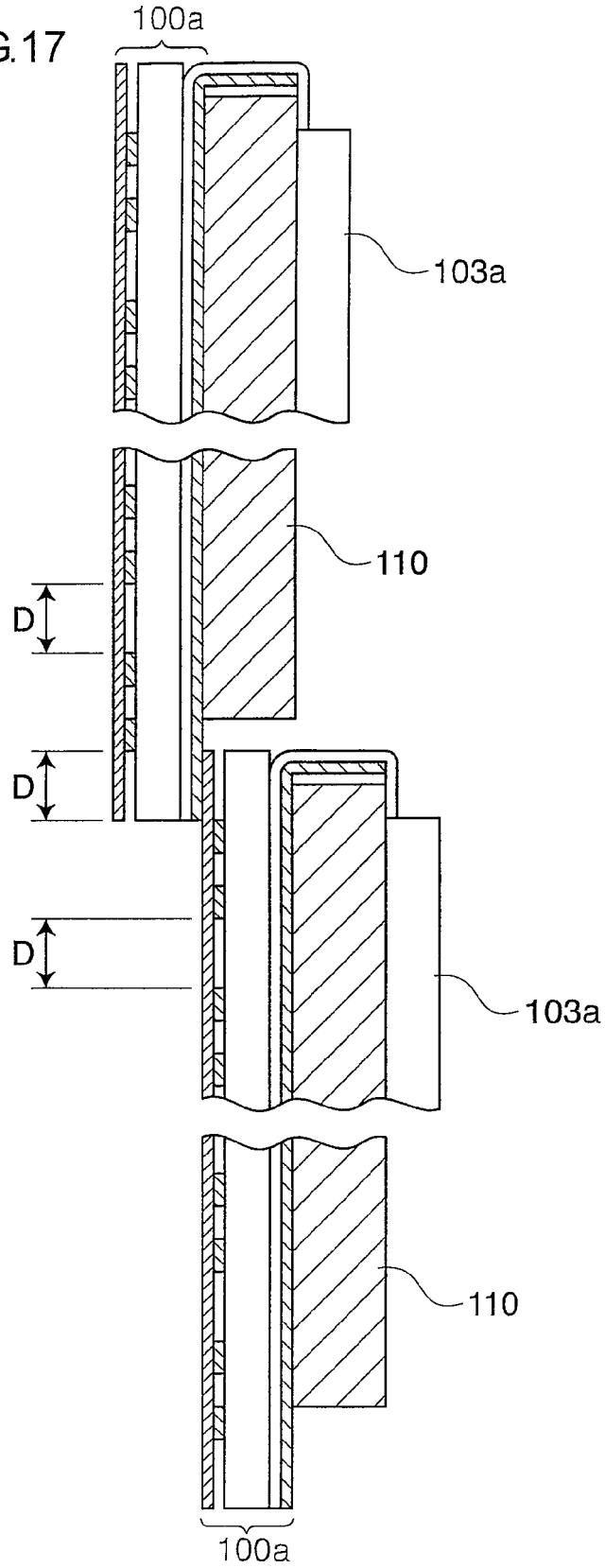

In FIG. 17, the edge non-display regions of the PTAs 100*a* of the unit modules Ma, Mb, Mc arranged in the two rows each have a width D/2<Da≤D as shown in FIG. 10(*b*). In this case, the unit modules aligned in the first row are offset by the thickness of the PTA 100*a* from the unit modules aligned in the second row, and overlap the unit modules aligned in the second row so that the non-display regions present on the connection portions each have a width equal to the width D. This also prevents the reduction in display quality (uneven display) attributable to the connection portions.

Figure 18:
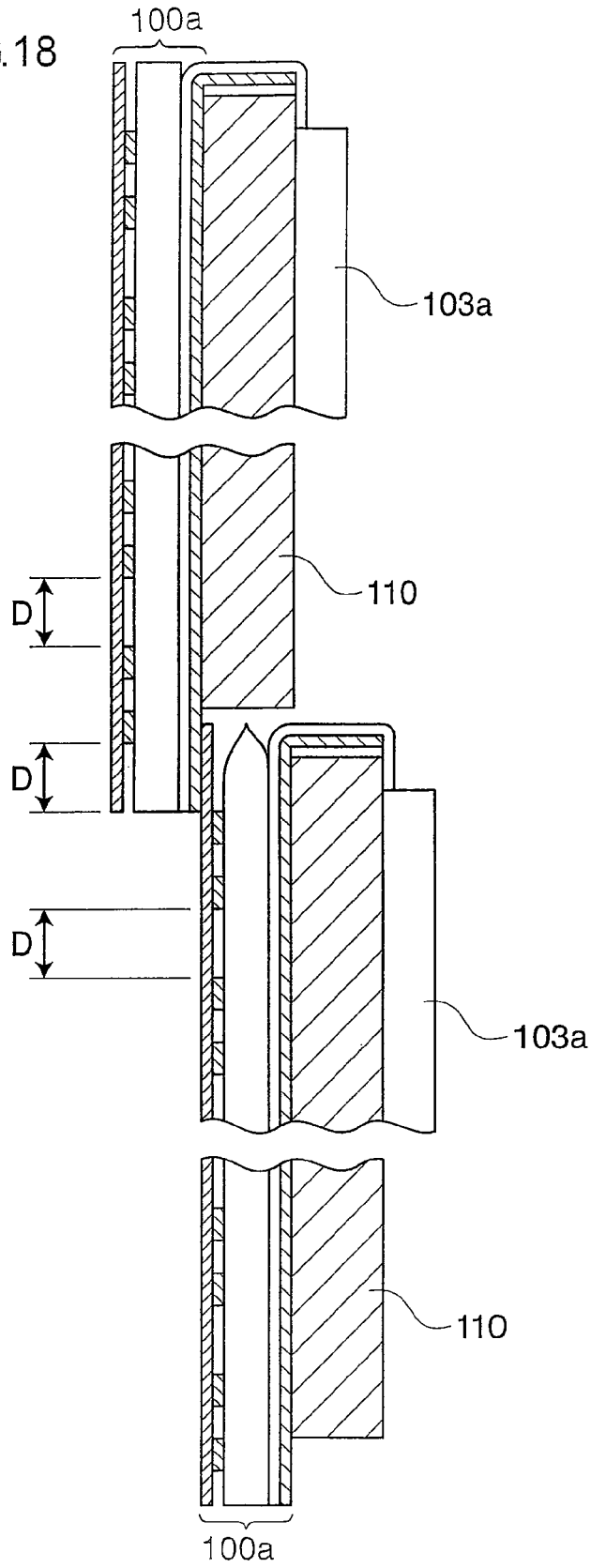

In FIG. 18, the edge non-display regions of the PTAs 100*a* of the unit modules Ma, Mb, Mc aligned in the first row each have a width Da≤D as shown in FIG. 10(*a*) or 10(*b*), and the edge non-display regions of the PTAs 100*a* of the unit modules Ma, Mb, Mc aligned in the second row each have a width Da>D as shown in FIG. 10(*c*). In this case, the unit modules aligned in the first row are offset by the thickness of the PTA 100*a* from the unit modules aligned in the second row, and overlap the unit modules aligned in the second row so that the non-display regions present on the connection portions each have a width smaller than the width D. This also prevents the reduction in display quality (uneven display) attributable to the connection portions.

Figure 19:
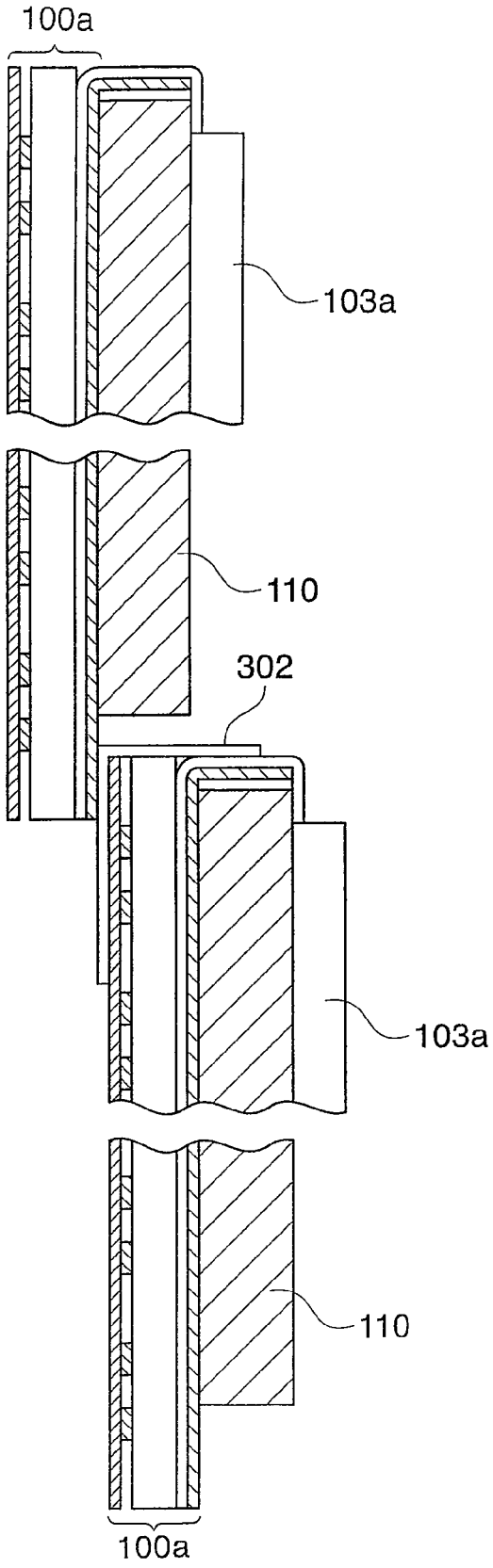

Referring to FIG. 19, the unit modules Ma, Mb, Mc arranged in the two rows are positioned as shown in FIG. 17, and a flexible sheet member 302 previous to light is provided between the overlap portions of the unit modules Ma, Mb, Mc aligned in the first row and the unit modules Ma, Mb, Mc aligned in the second row. This prevents direct contact between the unit modules aligned in the first row and the unit modules aligned in the second row, thereby protecting the PTAs 100*a* of the respective unit modules 100*a*.

Figure 20:
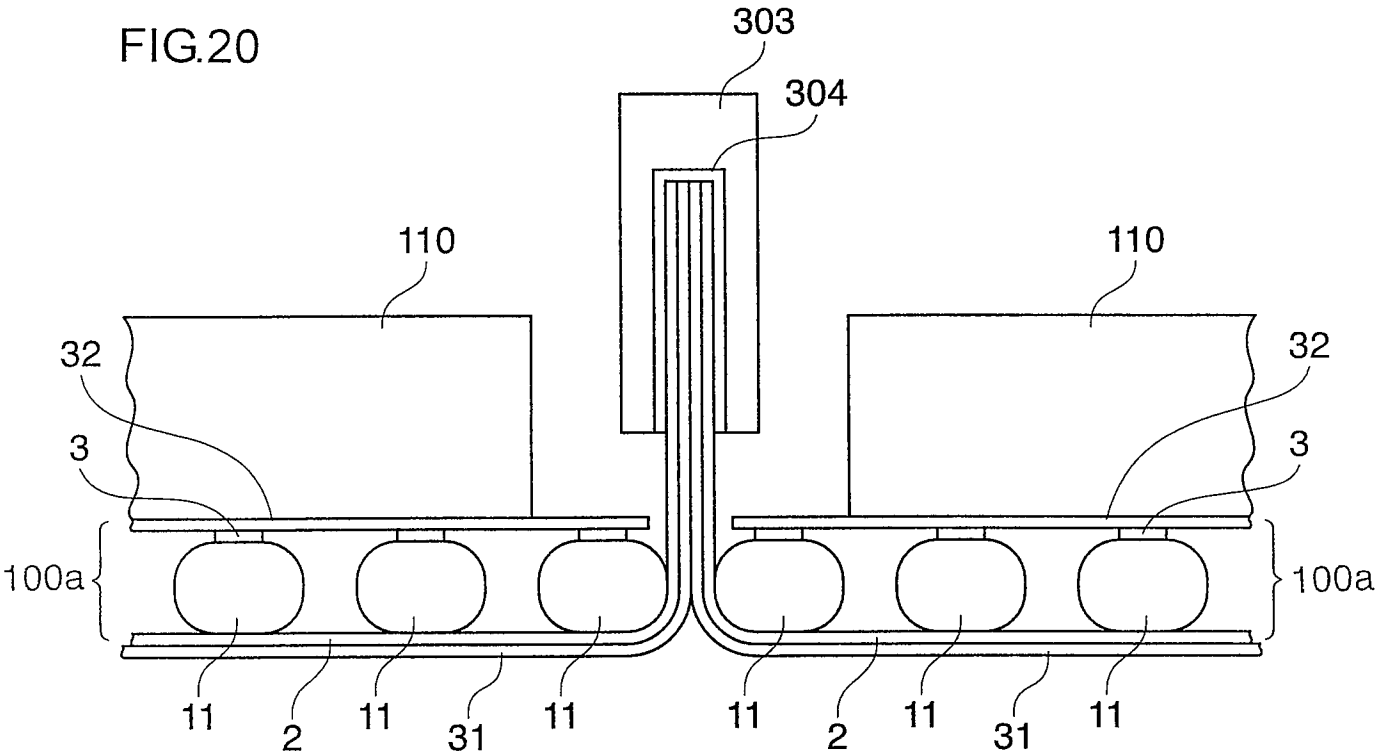
FIG. 20 is an enlarged view of a portion B in FIG. 15.

FIG. 20 is an enlarged view of a portion B in FIG. 15.

In adjoining portions of each two adjacent PTAs 100*a* aligned in the row direction, as shown in FIG. 20, the support plates 31 are each generally perpendicularly bent together with the display electrodes 2 toward the support plates 32. A connector 303 is attached to edge portions of the bent portions of the adjacent PTAs 100*a*, so that the display electrodes 2 of the adjacent PTAs 100*a* are electrically connected in series by an electrical conductor 304 of the connector 303. Therefore, a distance between adjacent plasma tubes present in the adjoining portions is the same as the pitch of the other plasma tubes. This prevents the reduction in display quality (uneven display) in the adjoining portions. Without the use of the connector 303, the connection of the electrodes may be achieved by holding the electrodes by a clip or by directly thermally crimping the electrodes.

Figure 21:
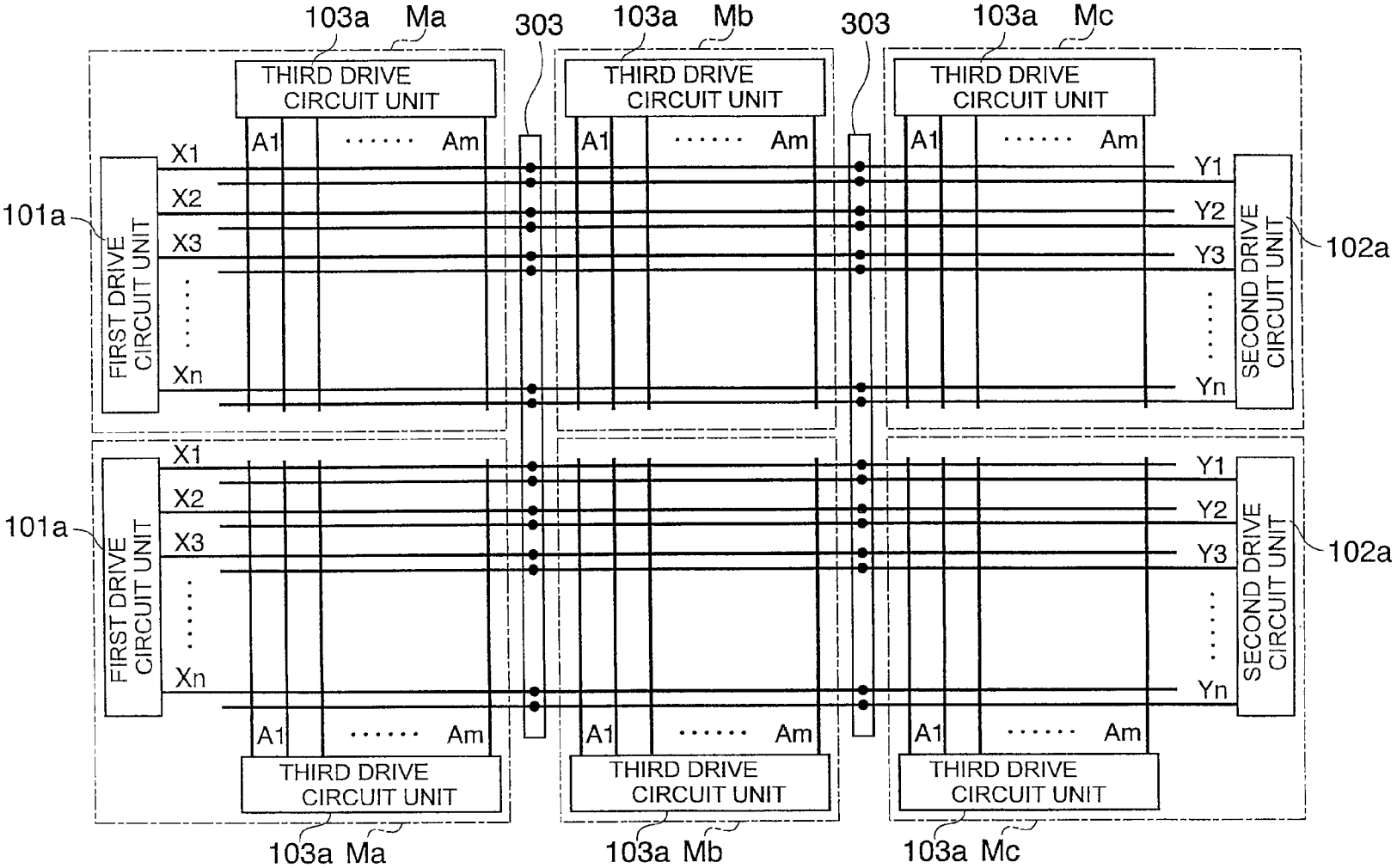
FIG. 21 is a block diagram illustrating drive circuits of the PTA device shown in FIGS. 13 to 15.

FIG. 21 is a block diagram illustrating drive circuits of the PTA device 200 shown in FIG. 13. As shown, the address electrodes A1 to Am of the respective modules Ma, Mb, Mc arranged in the first and second rows are driven by six independent third drive circuit units 103*a*.

The electrodes X1 to Xn of the respective modules Ma, Mb, Mc aligned in the first row are driven by a common first drive circuit unit 101*a*. The electrodes Y1 to Yn of the respective modules Ma, Mb, Mc aligned in the first row are driven by a common second drive circuit unit 102*a*.

Similarly, the electrodes X1 to Xn of the respective modules Ma, Mb, Mc aligned in the second row are driven by a common first drive circuit unit 101*a*, and the electrodes Y1 to Yn of the respective modules Ma, Mb, Mc aligned in the second row are driven by a common second drive circuit unit 102*a*.

Figure 22:
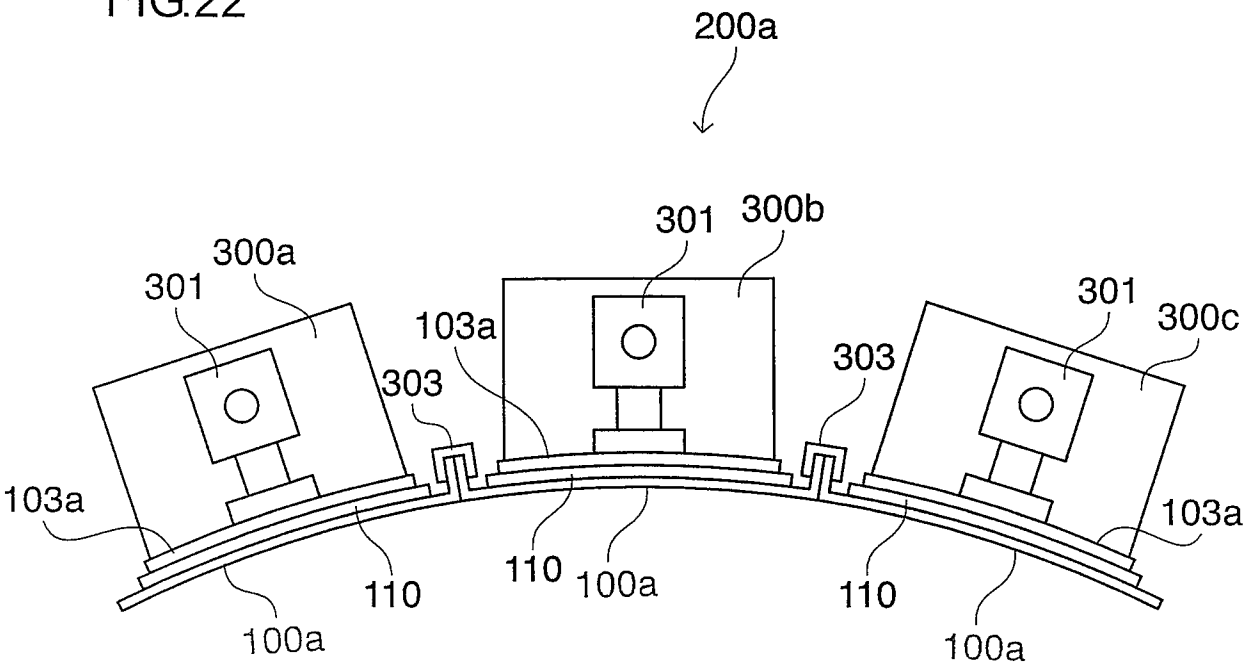
FIG. 22 is a diagram illustrating a modification of the PTA device shown in FIGS. 13 to 15 as corresponding to FIG. 15.

FIG. 22 is a diagram corresponding to FIG. 15, illustrating a PTA device 200*a* obtained by modifying the PTA device 200 shown in FIGS. 13 to 15. In this modification, as shown in FIG. 22, PTAs 100*a*, which are flexible in the row direction, are supported by a curved support frame 110 so as to be curved in the row direction.

In this case, flexible printed circuit boards are used as the third drive circuit units, and are mounted in a curved state on the support frame 110. The PTA device 200*a* has substantially the same construction as the PTA device 200 shown in FIGS. 13 to 15 except for the aforementioned point.

What is claimed is:

1. A display device comprising:

a plurality of plasma tube array units arranged in a matrix, each plasma tube array unit including:

a plurality of plasma tubes extending in a first direction and arranged parallel in a second direction crossing the first direction, each plasma tube having a first sealed end which has a first non-display region and a second sealed end which has a second non-display region;

a plurality of pairs of display electrodes formed on a front side flexible support plate and extending parallel to each other perpendicularly to the plasma tubes; and a plurality of address electrodes extending parallel to each other along the respective plasma tubes; wherein the plasma tube array units that are aligned in the second direction of the matrix adjoin outermost plasma tubes through a bent portion of the front side flexible support plate with the display electrodes therebetween; and the plasma tube array units that are aligned in the first direction of the matrix adjoin each other with a step therebetween such that each first non-display region of the first sealed end of the plasma tubes of one of the plasma tube array units overlaps with each second non-display region of the second sealed end of the plasma tubes of one of the adjacent plasma tube array units.

2. A display device set forth in claim 1, further comprising a support member provided on a rear side of the plasma tube array units, wherein the plasma tube array units are flexible and supported as being curved in the second direction by the support member.

3. A display device as set forth in claim 1, further comprising a connection member which electronically connects the bent portion of the display electrodes of each two adjacent plasma tube array units arranged in the second direction on a rear side of the display device.

4. A display device as set forth in claim 1, further comprising a support frame supporting the plasma tube array units on the front side, and a drive circuit for driving the display electrodes and address electrodes mounted on a rear side of the support frame.

5. The display device as set forth in claim 1, wherein a width Da1 of the first non-display region and width Da2 of the second non-display region are substantially equal and narrower than a third non-display region between adjacent two pair of display electrodes.

6. The display device as set forth in claim 5, wherein a width of a fourth non-display region defined on the overlap portion is substantially equal with a width D of the third non-display region, thereby the adjoining display units in the first direction constitute a continuous display screen through the overlap portion thereof.

7. A display device comprising:

a plurality of display modules each of which include a plurality of plasma tubes extending in a column direction and arranged in a row direction parallel to each other, a plurality of pairs of display electrodes extending parallel to each other perpendicularly to the plasma tubes, and a plurality of address electrodes extending parallel to each other along the plasma tubes;

wherein the display modules are arranged in a matrix and are supported by a support member so that the display modules aligned in the row direction of the matrix adjoin each other with no step therebetween and the display modules aligned in the column direction of the matrix adjoin each other with a step therebetween, wherein each plasma tube includes a first end which has a first non-display region, a second end which has a second non-display region, and a third non-display region between adjacent two pair of display electrodes, wherein a length Da1 of the first non-display region, a length Da2 of the second non-display region, and a length D of the third non-display region are defined as follows;

$Da1 \approx Da2 < D$ wherein the adjoined display modules in the column direction overlap each other to respectively have overlap portions and the first ends of the plasma tubes of a display module overlap the second ends of the plasma tubes of another adjacent display unit.

8. A display device comprising:

a plurality of display modules each of which include a plurality of plasma tubes extending in a column direction and arranged in a row direction parallel to each other, a plurality of pairs of display electrodes extending parallel to each other perpendicularly to the plasma tubes, and a plurality of address electrodes extending parallel to each other along the plasma tubes;

wherein the display modules are arranged in a matrix and are supported by a support member so that the display modules aligned in the row direction of the matrix adjoin each other with no step therebetween and the display modules aligned in the column direction of the matrix adjoin each other with a step therebetween, wherein each plasma tube includes a first end which has a first non-display region, a second end which has a second non-display region, and a third non-display region between adjacent two pair of display electrodes, wherein a length D1 of the first non-display region, a length D2 of the second non-display region, and a length D3 of the third non-display region are defined as follows;

$D3/2<Da1\approx Da2\leq D3$ wherein the adjoined display modules in the column direction overlap each other to respectively have overlap portions and the first ends of the plasma tubes of a display module overlap the second ends of the plasma tubes of another adjacent display module in the column direction.

9. A display device comprising:

a plurality of plasma tube arrays each of which include a plurality of elongated plasma tubes arranged in parallel, each of the plasma tubes being filled with a discharge gas, and a plurality of pairs of display electrodes disposed outside of the plasma tubes;

wherein each plasma tube includes a first sealed end which has a first non-display region of a length D1, a second sealed end which has a second non-display region of a length D2, and a third non-display region of a length D between adjacent two pairs of the display electrodes, and each of the non-display regions are defined as follows:

$D1\approx D2<D$ wherein at least two plasma tube arrays aligned in a longitudinal direction of the elongated plasma tubes adjoin each other with a step therebetween such that each first non-display region of the first sealed end of the plasma tubes of one of the plasma tube arrays overlaps with each second non-display region of the second sealed end of the plasma tubes of another adjacent plasma tube array.

10. A display device comprising:

a plurality of plasma tube arrays each of which include a plurality of elongated plasma tubes arranged in parallel, each of the plasma tubes being filled with a discharge gas, and a plurality of pairs of display electrodes disposed outside of the plasma tubes;

wherein each plasma tube includes a first sealed end which has a first non-display region of a length D1, a second sealed end which has a second non-display region of a length D2, and a third non-display region of a length D between adjacent two pairs of the display electrodes, and each of the non-display regions are defined as follows:

$D/2<D1\approx D2\leq D$ wherein at least two plasma tube arrays aligned in a longitudinal direction of the elongated plasma tubes adjoin each other with a step therebetween such that each first non-display region of the first sealed end of the plasma tubes of one of the plasma tube arrays overlaps with each second non-display region of the second sealed end of the plasma tubes of another adjacent plasma tube array.

* * * * *